US007926123B2

(12) United States Patent
Walburg

(10) Patent No.: US 7,926,123 B2
(45) Date of Patent: Apr. 19, 2011

(54) FLY POCKET PANTS

(75) Inventor: Joel Walburg, Oakland, CA (US)

(73) Assignee: Joel Walburg, Oakland, CA (US)

( * ) Notice: Subject to any disclaimer, the term of this patent is extended or adjusted under 35 U.S.C. 154(b) by 0 days.

(21) Appl. No.: 12/380,003

(22) Filed: Feb. 20, 2009

(65) Prior Publication Data

US 2009/0222974 A1 Sep. 10, 2009

Related U.S. Application Data

(60) Provisional application No. 61/066,745, filed on Feb. 22, 2008.

(51) Int. Cl.
*A41D 13/00* (2006.01)
*A41D 27/20* (2006.01)

(52) U.S. Cl. ..... 2/227; 2/247

(58) Field of Classification Search ..... 2/227, 228, 2/238, 400, 403, 405, 247, 250–254, 96
See application file for complete search history.

(56) References Cited

U.S. PATENT DOCUMENTS

| | | | | | |
|---|---|---|---|---|---|
| 666,246 | A * | 1/1901 | Henderson | 2/237 |
| 2,498,048 | A | 2/1950 | Neinken | |
| 2,544,840 | A * | 3/1951 | Kowatsch | 2/67 |
| 3,137,862 | A * | 6/1964 | Mizerak | 2/400 |
| 3,149,343 | A * | 9/1964 | Jacobson | 2/235 |
| 4,006,494 | A * | 2/1977 | Knoppel | 2/227 |
| 4,068,321 | A * | 1/1978 | Chayer | 2/227 |
| 4,077,067 | A * | 3/1978 | Kozdal | 2/234 |
| 4,139,914 | A | 2/1979 | Tarr | |
| 4,145,762 | A * | 3/1979 | Wallach | 2/67 |
| 5,561,865 | A | 10/1996 | Fjelstul | |
| 6,199,215 | B1 * | 3/2001 | Biggerstaff | 2/234 |
| 7,231,672 | B2 * | 6/2007 | Thomas | 2/400 |

* cited by examiner

*Primary Examiner* — Gloria Hale
(74) *Attorney, Agent, or Firm* — Quine Intellectual Property Law Group; Gary Baker

(57) ABSTRACT

This invention provides pants with vertical pocket openings at the pant front center. The pants can have a central vertical closure, such as a zipper, with the pocket opening optionally internally adjacent or externally adjacent to the closure.

32 Claims, 6 Drawing Sheets

FLY POCKET PANTS

CROSS-REFERENCE TO RELATED APPLICATIONS

This application claims priority to and benefit of a prior U.S. Provisional Application No. 61/066,745, Fly Pocket Pants, by Joel Walburg, filed Feb. 22, 2008. The full disclosure of the prior application is incorporated herein by reference.

FIELD OF THE INVENTION

The present inventions are in the field of garments, such as pants with pockets. Pockets are located with front and central openings to provide convenient access.

BACKGROUND OF THE INVENTION

Pants typically have horizontal pocket openings at the left and right front or sides of pants. However, access to these pockets by the wearer is not as convenient or logical as one may think. With the pocket opening horizontal high on the sides, the pants wearer must raise their hands and enter the pocket by bending at the elbow and wrist in order to align the hand with the pocket. Moreover, with the pocket openings at the lateral positions, the fabric line at the hips is unflatteringly and unfashionably disrupted. As a further concern, lateral pocket openings provide opportunities for pick pockets to gain access to pockets with reduced likelihood of detection.

Attempts have been made to provide more elegant and secure pockets. For example, in U.S. Pat. No. 2,498,048, to Neinken, a pocket is sewn into the tongue fly of a pair of trousers. However, access to the pocket is poor and the pocket is necessarily small.

U.S. Pat. No. 4,006,494, to Knoppel, and U.S. Pat. No. 5,561,865, to Fjelsul, each provide a large pocket mounted across the outside front of a pair of trousers. However, the pants may appear somewhat inelegant and create issues around the logistics of changing the pants and providing for convenient private bodily functions.

U.S. Pat. No. 4,139,914, to Tarr, provides a removable pocket that mounts along the top hem of pants with the body of the pocket suspended down inside the upper pants. This invention seems to provide good security, but less convenient access to pocket contents.

In view of the above, a need exists for a pockets having improved ergonomic access. It would be desirable to have pants with large pockets that are not distractingly mounted across the front of pants, and without interfering with traditional pants closure systems. The present invention provides these and other features that will be apparent upon review of the following.

SUMMARY OF THE INVENTION

Pants of the invention include one or more pockets that are accessed through an opening at the front center of the pants. This ergonomic design allows for large and concealable pockets. For example, the pants can include a pocket having a front central vertical access through a front central vertical pocket opening. The opening can be associated or aligned with a central pants closure, such as traditional zipper hardware.

The pants pockets with front central vertical openings can be configured a number of ways. The pockets can be directly mounted to the inside or outside of the pants shell. For example, the pocket can comprise a sheet of fabric sewn onto an inside surface of a left or right hip section of the pants shell, or the pocket can comprises a pouch separate from hip section fabric of the pants (left and right sections separated by the centerline). The interior space of the pocket can extend inside the pants to the left and/or to the right from the pocket opening. In preferred embodiments, the pocket extends from the opening laterally and down to an upper leg section of the pants. In many embodiments, the pocket body is not mounted to the outside of the pants shell (but only mounted to the pants at the pocket opening).

The pocket opening can be concealed from view. For example, a fly can conceal the pocket opening. Optionally, the pocket opening can be concealed by locating the opening behind elements of a pants closure system or an apparent front center seam. In a preferred embodiment, the pocket opening on the outside of the pants but aligned with the pants closure and hidden, e.g., by a fly. Optionally, the pocket opening can be closed and/or concealed by pocket closure, such as, e.g., a pocket flap or zipper.

The pants closure closes the pants waistline. The pants closure is typically a zipper, a row of two or more buttons, a row of two or more snaps, a strip of hook and loop material or the like. Optionally, the pants closure is independent from the pocket opening, e.g., not at the front center of the pants, but located to the side or at the rear of the pants.

In one aspect of the invention, the pants include a second pocket also having a front central vertical opening. In a preferred embodiment of this aspect, the second pocket extends left if the first pocket extends right, or the second pocket extends right if the first pocket extends left.

In an embodiment, the pants have a pocket opening just inside the pants closure. For example, the pants can have a front central vertical pants closure between a left hip section and a right hip section, and have a pocket with an opening internal to and aligned with the pants closure. The pants can further include a second pocket, which has an opening external to and aligned with the pants closure.

In a more preferred embodiment, the pants have a pocket opening just outside and adjacent to the closure. For example, the pants can have a front central vertical pants closure between a left hip section and right hip section, and have a pocket with an outside access opening external to and aligned with the closure.

DEFINITIONS

Unless otherwise defined herein or below in the remainder of the specification, all technical and scientific terms used herein have meanings commonly understood by those of ordinary skill in the art to which the present invention belongs.

Before describing the present invention in detail, it is to be understood that this invention is not limited to particular devices or biological systems, which can, of course, vary. It is also to be understood that the terminology used herein is for the purpose of describing particular embodiments only, and is not intended to be limiting. As used in this specification and the appended claims, the singular forms “a”, “an” and “the” include plural referents unless the content clearly dictates otherwise. Thus, for example, reference to “a fabric” can include a combination of two or more fabrics, and the like.

Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

As used herein, the term "about" means the cited parameter is the same or nearly the same (e.g., within about 15%, 10%, 5% or less) as the value provided.

The term "substantially", refers to being largely, but not necessarily entirely, that which is specified.

Directional terms, as used herein, generally refer to, e.g., a pair of pants or shorts as worn by a person standing up. For example, a top or upper hem would be the hem terminating the pants in the waist area. Outside surfaces are those surfaces directly exposed to the external environment, e.g., open to view and not generally in contact with the wearer, as worn. Inside surfaces are those surfaces facing the inside of the pants, as worn, toward the wearer and generally out of view to outside observers. The front of pants is the portion of the pants facing forward, as worn by a person. The front central direction is the middle of the front of pants, e.g., where a zipper closure is typically found in men's pants. A vertical opening or closure runs largely in a direction from top to bottom or bottom to top.

As used herein, the term "pants" refers pants as known in common usage. Pants are an outer garment intended to be worn covering at least part of each leg separately and extending from the waist (or optionally, hip) to the ankle (e.g. trousers), or optionally a fraction of the distance from the waist (or hip) to the ankle (e.g., shorts and capri pants). Pants, as used herein, are generally not intended to include "undergarments" such as briefs, panties or boxers intended to be worn under pants. Alternately, some undergarments can be considered pants of the invention.

As used herein, the term "pocket" refers to a pocket in an article of clothing, as is commonly known and as is well known to one of skill in the art. For example, a pocket can be a small bag that is sewed or inserted in a garment with an opening for access to the interior. A pocket can be formed, e.g., by stitching the edges of a piece of fabric onto the inner or outer surface of a garment as an appliqué, leaving one section of edge unstitched providing an opening for access to the pocket interior (e.g., as in back pockets of blue jeans). Optionally, a pocket can be formed as a pouch of material largely independent of the exterior pants shell fabric of the garment but mounted to the garment at the pocket opening (e.g., as in typical front pockets of blue genes). However, in contrast to typical pants, such as blue jeans, the pocket openings of the present invention are located more toward the front center of the pants and aligned substantially vertically.

As used herein, the term "concealing" refers to placing an item out of direct view from an outside observer. For example, the item can be located inside a garment or covered with a garment feature, such as a fly.

As used herein, the term "fly" is as is well known in the art. A fly can be, e.g., a fold of cloth extending over and concealing a closure.

As used herein, the "front left hip section" of a pair of pants is the portion of the pants (e.g., portion of the pants shell) running generally from the front center line (typically, where the closure is located) extending laterally left (e.g., to the left side of the pants), and running from the left front upper waist hem (waistline) down to the level of the crotch. The "front right hip section" of a pair of pants is the portion of the pants running generally from the front center line extending laterally right, and running from the right front upper waist hem down to the level of the crotch.

A "leg section" of a pair of pants is the section of the pants shell running down from the crotch level to the lower hem of the pants. For example, it is the section of the pants that covers a wearer's leg.

A "front central vertical opening" to a pocket is a substantially vertical pocket opening located at the front center of a pair of pants, or immediately adjacent to the front center. Substantially vertical is vertical or at least close to vertical (e.g., within 30°, 20°, 10°, 5° or less of vertical), as viewed from directly in front of the wearer. Immediately adjacent is at least near the cited structure, e.g., within 2 inches, 1 inch, 0.5 inches, or less. Stated another way, a "front central vertical opening" of the invention can be a pocket opening that is more vertical than horizontal and located entirely within a front central strip not wider than 20% (or 10%, or 5% or less) of the pants width at the same level.

A pocket opening is "aligned with a pants closure" when the closed pocket opening is within 30° (or, e.g., within 20°, 10°, 5° or less) of being parallel to the alignment of the closed pants closure.

A pocket pouch is separate from a hip section if it is not directly mounted (e.g., stitched onto) to the hip section material. The pocket pouch is considered separate from the hip section even if the pocket opening is mounted to the hip section.

DETAILED DESCRIPTION

The pants of the present invention typically include one or more front pockets that have an opening at about the centerline of the pants. This arrangement provides a slim and unbroken surface across the front of the pants hip section and provides ergonomic access to the pockets by the wearer. The centerline pockets avoid the need for openings at the lateral hip front and/or sides of the pants, thereby providing a close, comfortable and attractive fit. A left pocket, with a vertical centerline opening, can be naturally and directly accessed using the right hand, e.g., without the need for complex motions, even while the wearer is seated.

A general description of the pants of the invention includes a generic pants shell having one or more pockets with a generally vertical opening along the center front of the pants. In many cases, the pants also include a central vertical closure (e.g., a zipper with a top button or snap). The pocket openings can be visible or concealed, external and/or internal to the shell, immediately adjacent to the closure or offset some distance from the closure.

Pants

Figure 1:
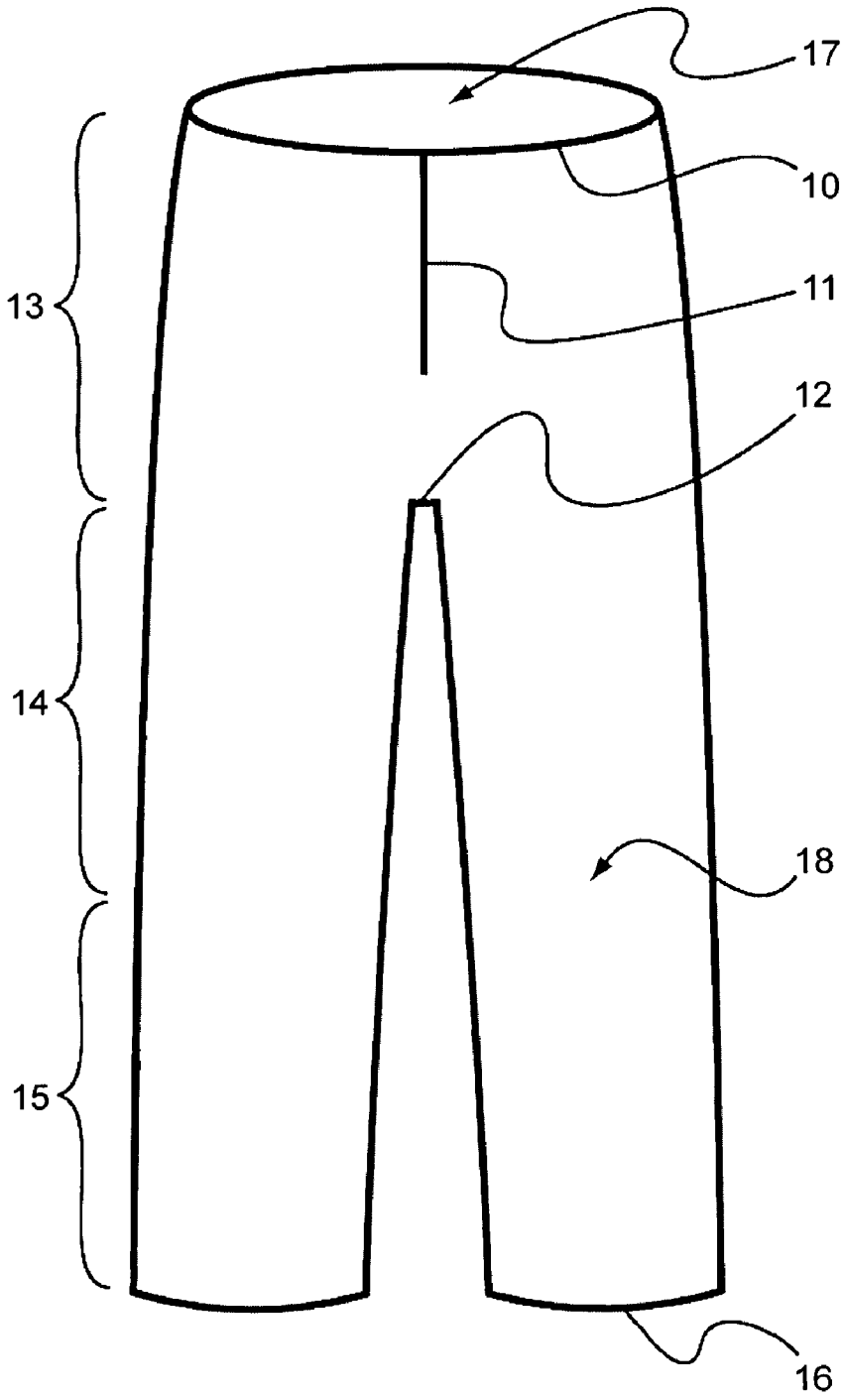
FIG. 1 is a schematic diagram showing parts of a generic pair of pants.

The present invention is directed to the functional positioning of pockets in pants. The pants can be any type, e.g., shorts, knee-length or ankle length pants. The general structure of pants (shell) can include a waistline 10, front centerline 11, crotch 12, hip section 13, upper leg section 14, lower leg section 15, and lower hem 16, an interior 17, and an exterior 18, as shown in FIG. 1.

In pants of the invention, a pocket opening is present on the front centerline, or immediately adjacent to the centerline (e.g., within 2 inches, 1 inch, 0.5 inch, 0.3 inch, 0.1 inch or less from the centerline), running substantially parallel to the centerline.

Optionally, the pants can include a closure. Typically, the closure comprises a slit running down from the waistline, which when open, can effectively increase the circumference at the top of the pants, so the pants can be pulled on or off over the wearer's hips. Optionally, the pants can have no closure, e.g., functioning with an elastic waistline, or held up with suspenders or a belt.

Closures

Pants of the invention can include any type of closure, or no closure at all. The closures can include closure hardware, e.g., zippers, buttons, snaps, hook and loop (e.g., VELCRO™), laces, and/or the like. The closures typically function to releasably hold sides of a pants slit (placket), or break in the waistline, together.

Figure 2:
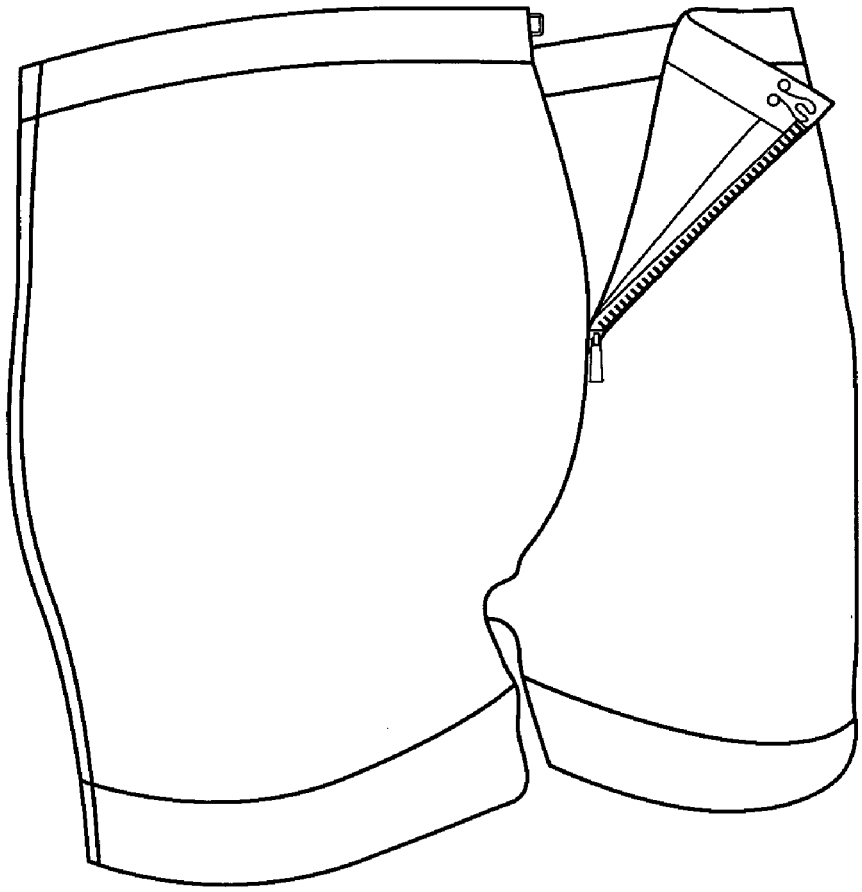
FIG. 2 is a schematic diagram of short pants with a pants closure located in the rear of the pants.

In a preferred embodiment, the closure is a vertical closure running down some distance from the waistline. The closure slit can extend about 1 inch, 2 inches, 4 inches, 8 inches or more, from the waistline. In preferred embodiments, the closure is a central vertical closure or a closure immediately adjacent (e.g., within 2 inches, within 1 inch, or within 0.5 inches) to the front centerline of the pants. Alternately, the pants can have a side closure or a rear closure, as shown in FIG. 2.

In many embodiments, the pants closure includes a fly 37, to conceal and protect the closure hardware.

Pockets

Pockets of the invention have an opening at or near the pants front centerline and generally aligned with the centerline. The pockets can be of any suitable size and can run laterally and/or down, e.g., the inside or outside of the pants shell.

It is an aspect of the invention that an opening of a pants pocket is located at about the centerline of the pants front. In preferred embodiments, the pocket opening is at the centerline and runs along the centerline. In other embodiments, the pocket opening is immediately adjacent (e.g., e.g., within 2 inches, within 1 inch, or within 0.5 inches) of the centerline and running substantially parallel (e.g. within a 30 degree angle, 20 degree angle, 10 degree angle, 5 degree angle, 2 degrees or less) to the pants front centerline.

The pocket opening can be any suitable circumference, e.g., so that objects, such as coins, combs, electronic devices, wallets, etc, can be functionally received. For example, the pocket opening can be about 0.5 inch, 1 inch, 2 inches, 3 inches 4 inches, 6 inches, 8 inches, or more in closed length (e.g., twice these values for total opening circumference).

The pocket can have an internal length and width (measured flattened) appropriate to hold the desired objects. For example, the pocket can have a length and/or width ranging from more than 10 inches to less than 1 inch, from about 8 inches to 2 inches, from about 6 inches to about 3 inches, or about 5 inches. In a preferred embodiment, the pocket is about 8 inches long and about 6 inches wide.

Pockets of the invention are mounted (at the opening edges and/or at the pocket body periphery) to the pants with so they run laterally left and/or right from the central opening. Typically the pockets run either left or right from center, but usually not as a single pocket running both directions from center. Pockets can be mounted to the pants shell, e.g., by sewing the periphery along three of four edges onto the shell, leaving one edge as the pocket opening. This appliqué style mounting can be on the inside or outside of the shell. Typically the stitching or pocket edges are visible to an outside viewer and can provide a decorative shape or stitch work. Alternately, the pocket can be essentially a sock or bag that is sewn at the opening to a pants shell edge or to a slit in the shell, e.g., with the body of the pocket suspended laterally and/or down inside the pants. In this configuration, the presence of the pocket is not readily apparent to an outside observer, especially if the pocket opening is concealed, e.g., with a fly, or if the opening is configured to look like a vertical center seam.

The opening to the pocket can include a security closure, e.g., to prevent objects from falling out, inhibit pickpockets and to help retain a neat fabric lie. In many embodiments, particularly where the pocket opening is located on the outside of the pants shell, the pocket opening can have a pocket closure. For example, the pocket can be closed with a buttoned flap, a zipper, hook and loop fabric, snaps, or the like.

Figure 4:
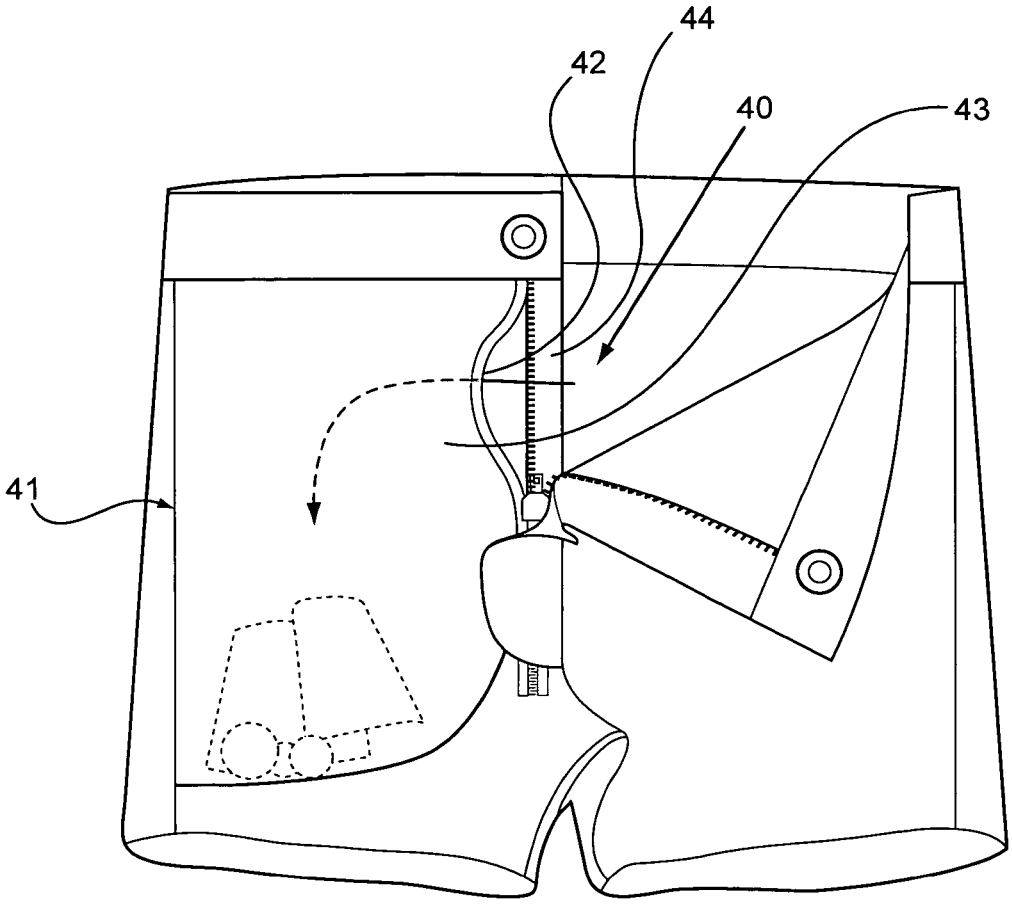
FIG. 4 is a schematic diagram of central pocket pants wherein the pocket opening is located behind a pants closure.

The pockets of the invention can run any suitable direction and distance for a particular situation. Many old art pockets have horizontal pocket openings and the pocket body can only run down. In pants of the invention, the pocket opening is typically aligned vertically at or about the center front of the pants. In embodiments where the pocket body runs only laterally from the opening, it can be beneficial to include a pocket closure, as discussed above, to help retain objects in the pocket. In many embodiments, the body of the pocket runs laterally and down, as shown in FIG. 4. Having at least a portion of the pocket body lower than the lowest part of the pocket opening can help stabilize objects in the pocket while still allowing a large upper portion of the pocket to accommodate large objects.

Using Center Pocket Pants

The center pocket pants have certain ergonomic advantages that allow more natural motions to access the pocket contents. The design is flexible, with configurations to address various pocket use priorities.

For many old art pants front pockets, the wearer must go through contortions to add or remove an object from the pockets. For example, to remove an object from a typical laterally mounted right front pocket with the right hand, the wearer must shrug his shoulder up, bend the elbow with the upper arm back, supinate the lower arm, and bend the wrist down, before he can insert his right hand into the pocket. The contortions only become more exaggerated, or impossible, if the wearer is in the sitting position.

To use pockets of the invention, to capture an object in the left pocket, one need simply bend the right elbow to the appropriate angle and insert the right hand directly into the pocket.

The pockets of the invention are relatively secure do to their up front but unexpected opening location. Security can be enhanced using any of a number of aspects of the pockets. A particularly secure embodiment is where the pocket is not visibly stitched onto the pants shell and where the pocket opening is concealed. For example, the pockets can be mounted only at the opening edge, with the opening inside the pants, appearing as a stitched seam or hidden behind a fly. Security can be further enhanced by inclusion of a pocket closure, such as a zipper, at the pocket opening.

Center pocket opening pants can provide the utility of pockets along with desirable styling options. For example, old art horizontal or diagonal pocket openings in the pants side or front hip section can distract from the lines and lie of the fabric. Because a closure placket is a functional necessity in many pants, the present inventive pockets can be incorporated into the pants closure system without additional clutter in the pants design. All this, while providing the possibility of easy to use, secure, large, comfortable pockets.

EXAMPLES

The following examples are offered to illustrate, but not to limit the claimed invention.

Example 1

Pocket Opening Outside Closure but Concealed

The pants with central pocket openings can be configured to be easily accessed yet not be visible to outside observers.

Figure 3A:
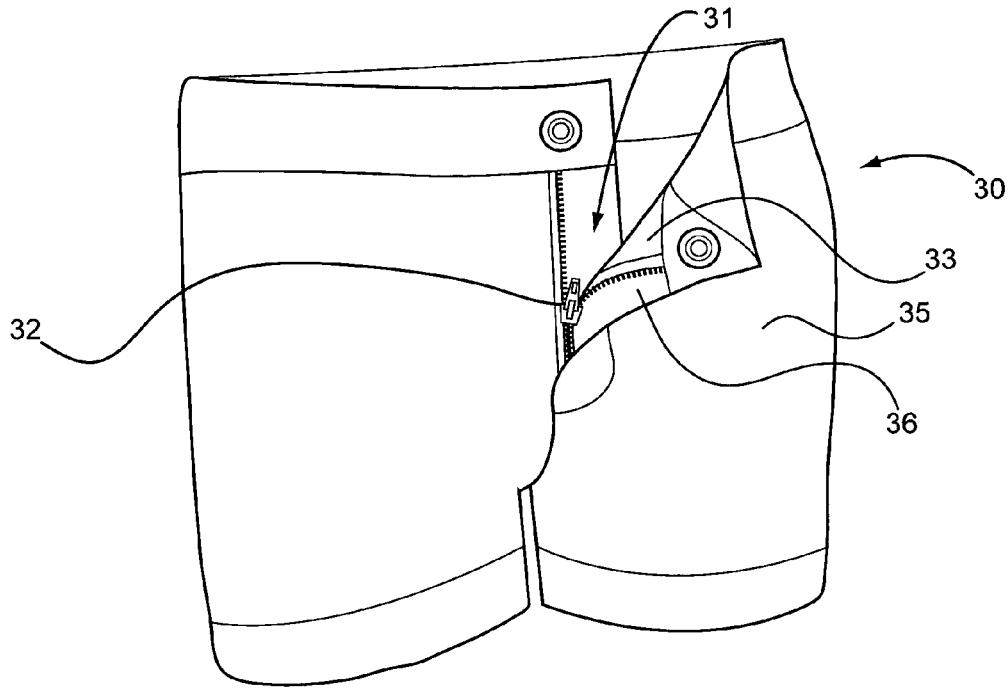
FIGS. 3A and 3B are schematic diagrams of central pocket pants wherein the central vertical pocket opening of a left pocket is concealed by a fly and includes an opening outside of a pants closure zipper.
Figure 3B:
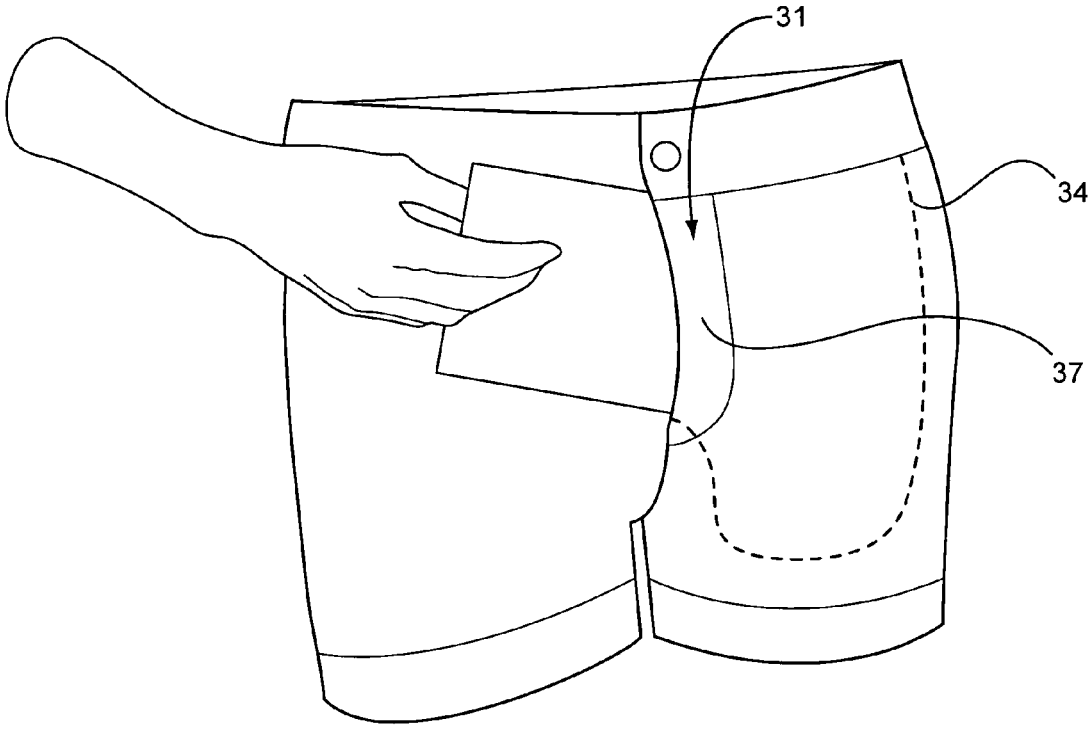

Pants 30 (here, in a "shorts" embodiment, as shown in FIGS. 3A and 3B) can have a closure 31 with a conventional appearance, in use. The zipper 32 pants closure hardware is mounted normally to the pants on the right side, but with the left side of the zipper mounted to an interior panel 33 of fabric (e.g., anchored to the pant side seam, and optionally acting as the pocket back wall). The pocket 34 is formed between the interior panel of fabric and the pants shell at the left hip section 35. The pocket opening 36, is concealed with a fly 37.

Figure 3C:
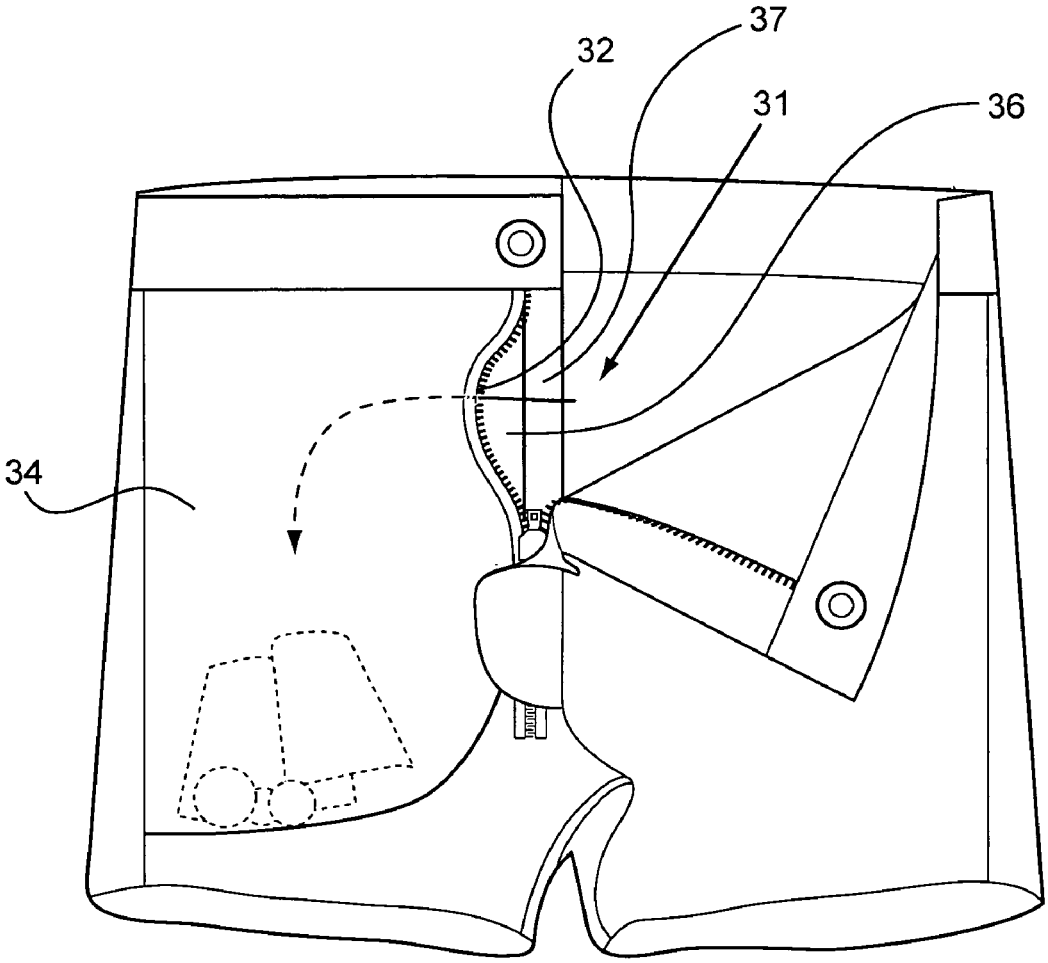
FIG. 3C is a schematic diagram of pants 3A turned inside out so the inside surfaces of the pants can be viewed.

To better view the internal arrangement of structures in this embodiment the pants are shown inside out in FIG. 3C. That is, in FIG. 3C, the pants of 3A have been pulled inside out, thus exposing inside surfaces for view. The pants would not normally be worn by a person in this inside out configuration.

In this embodiment, objects can be readily accessed through the pocket opening, which does not have pocket closure hardware. The pocket extends laterally across the left front hip section and also down to the upper front leg section of the pants.

Example 2

Pocket Opening Inside Closure

In this embodiment, the central opening pants pocket has an opening behind the pants closure. Such an embodiment provides security by concealing the presence of a pocket and by closing access to the pocket opening.

FIG. 4 is a schematic diagram of inside out pants. As shown in FIG. 4, the pocket opening 42 would be on the inside of the pants, and inside of the pants closure 40, when the pants are worn normally "outside out". In this embodiment, the pants closure 40, is essentially a normal closure with a zipper mounted to typical left and right plackets. However, a pocket 41 with a central vertical opening 42 is formed between the inside of the right front hip section and an interior panel 43 of fabric. The pocket opening is defined by the right side of the zipper and the left edge of the interior panel (as normally worn outside out). The pocket opening is normally concealed by the zipper and a fly 44.

In this embodiment, in order to access the contents of the pocket, as normally worn outside out, the wearer unzips the zipper and reaches left laterally into the pocket, e.g., with the right hand.

Example 3

Central Pocket not Associated with a Pants Closure

Figure 5A:
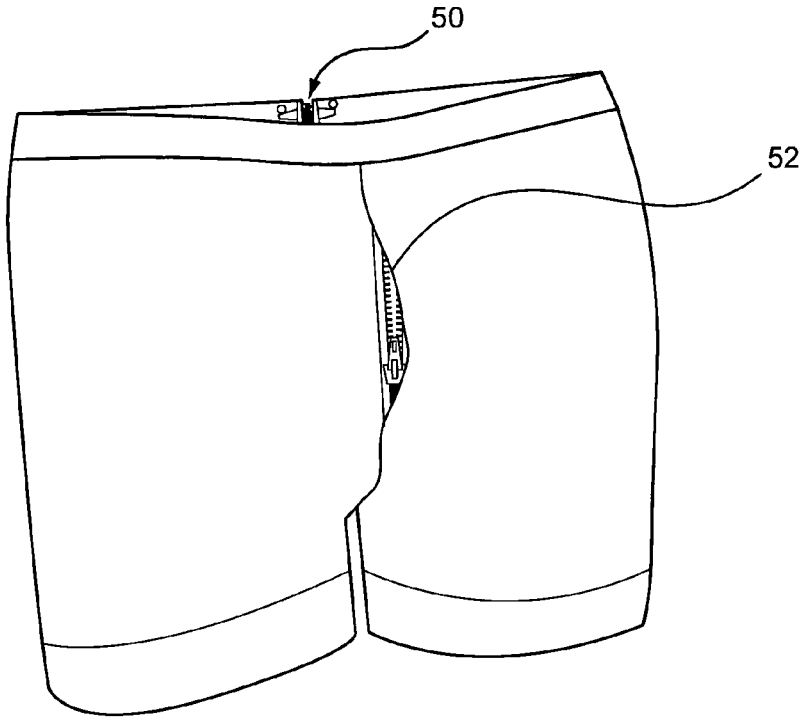
FIGS. 5A and 5B are schematic diagrams of central pocket pants wherein the pocket opening is separate from the pants closure and the pocket opening has zipper pocket closure hardware.
Figure 5B:
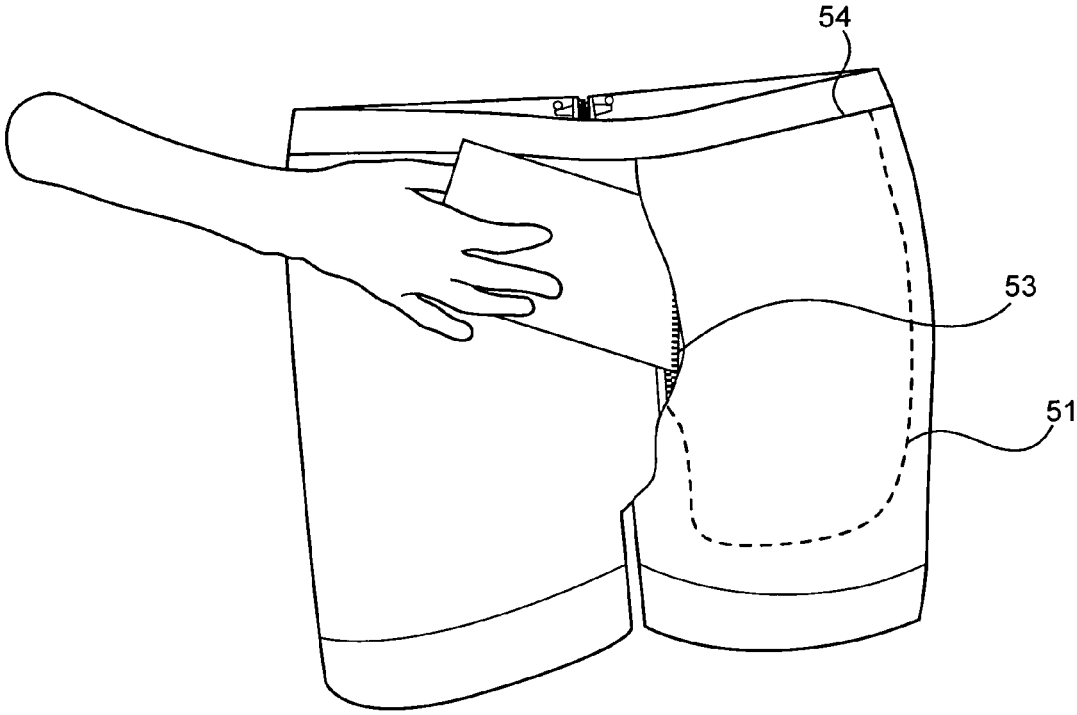

Central front vertical opening pockets do not have to be associated with a pants closure structure. In this embodiment, as shown in FIGS. 5A and 5B, the pants closure 50 is in the back center of the pants (typically, for a feminine design; optionally, with a side closure, or closure anywhere along the waist). Also see FIG. 2.

The pocket 51 includes a central vertical opening 52 defined by a zipper pocket closure 53. So the pocket outline is not apparent to outside viewers, the pocket is a pouch suspended internally from the waistline hem 54 and running down behind the left hip section of the pants shell to the upper leg section of the pants.

It is understood that the examples and embodiments described herein are for illustrative purposes only and that various modifications or changes in light thereof will be suggested to persons skilled in the art and are to be included within the spirit and purview of this application and scope of the appended claims.

While the foregoing invention has been described in some detail for purposes of clarity and understanding, it will be clear to one skilled in the art from a reading of this disclosure that various changes in form and detail can be made without departing from the true scope of the invention. For example, many of the techniques and apparatus described above can be used in various combinations.

All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. Pants comprising:

an interior, an exterior surface, a left hip section, a right hip section and a front center of the pants between the right hip section and the left hip section;

a left leg section extending down from the left hip section;

a right leg section extending down from the right hip section; and, a first pocket comprising an opening, which pocket is mounted to the pants with the pocket opening oriented vertically at the front center of the pants.

2. The pants of claim 1, wherein an interior space of the pocket extends inside the pants to the left or to the right from the opening.

3. The pants of claim 1, further comprising a pocket closure on the pocket opening.

4. The pants of claim 1, further comprising a fly concealing the pocket opening.

5. The pants of claim 1, further comprising a pants closure that is not at the front center of the pants.

6. The pants of claim 1, further comprising a pants closure at the front center of the pants and aligned with the pocket opening.

7. The pants of claim 6, wherein the pocket opening is concealed behind the closure.

8. The pants of claim 1, further comprising a left front hip section and a right front hip section, wherein the pocket comprises a sheet of fabric sewn onto an inside surface of the left or right hip section.

9. The pants of claim 1, further comprising a left front hip section and right front hip section each comprising an outer sheet of fabric, wherein the pocket comprises a pouch separate from either sheet of outer hip section fabric.

10. The pants of claim 1, wherein the pocket is not mounted on the exterior surface of the pants.

11. The pants of claim 1, wherein the pocket extends from the pocket opening down to the left leg section or to the right leg section of the pants.

12. The pants of claim 1, further comprising a second pocket comprising a vertical pocket opening mounted to the front center of the pants, wherein the second pocket extends left if the first pocket extends right, or wherein the second pocket extends right if the first pocket extends left.

13. Pants comprising:

a left front hip section and a right front hip section;

a front central vertical pants closure between the hip sections; and, a first pocket comprising a vertical pocket opening internally adjacent to the pants closure and aligned with the pants closure.

14. The pants of claim 13, further comprising pocket closure on the pocket opening.

15. The pants of claim 13, further comprising a fold of cloth extending over the closure and concealing the pants closure.

16. The pants of claim 13, further comprising a second pocket, which pocket comprises a vertical opening externally adjacent to the pants closure and aligned with the pants closure.

17. The pants of claim 13, wherein the pants closure is selected from the group consisting of: a zipper, a row of two or more buttons, a row of two or more snaps and a strip of hook and loop material.

18. The pants of claim 13, wherein the pocket comprises a sheet of fabric sewn onto an inside surface of the left or right hip section, but not sewn to the hip section at the pocket opening.

19. The pants of claim 13, wherein the pocket comprises a pouch separate from the left hip section of the pants and separate from the right hip section of the pants.

20. The pants of claim 13, wherein the pocket is not mounted directly to an outside exterior surface of the pants.

21. The pants of claim 13, wherein the pocket extends from the opening down to an upper leg section of the pants.

22. Pants comprising:

a front central vertical pants closure between a left front hip section and a right front hip section; and, a pocket comprising a vertical pocket opening externally adjacent to the pants closure and aligned with the pants closure.

23. The pants of claim 22, wherein the closure is selected from the group consisting of: a zipper, a row of two or more buttons, a row of two or more snaps and a strip of hook and loop material.

24. The pants of claim 22, wherein the pocket comprises a sheet of fabric sewn onto an inside surface of the left front hip section or right front hip section.

25. The pants of claim 22, wherein the pocket comprises a pouch separate from the left hip section of the pants and separate from the right hip section of the pants.

26. The pants of claim 22, wherein the pocket extends from the opening down to an upper leg section of the pants.

27. The pants of claim 1, wherein the pants are other than an undergarment.

28. The pants of claim 1, wherein the pants are trousers, shorts or capri pants.

29. The pants of claim 13, further comprising a left leg section extending down from the left hip section or a right leg section extending down from the right hip section.

30. The pants of claim 13, wherein the pants are other than an undergarment.

31. The pants of claim 22, further comprising a left leg section extending down from the left hip section or a right leg section extending down from the right hip section.

32. The pants of claim 22, wherein the pants are other than an undergarment.

* * * * *